US006926271B2

(12) United States Patent
Hanson et al.

(10) Patent No.: US 6,926,271 B2
(45) Date of Patent: Aug. 9, 2005

(54) FLAT MAIL EDGE BIASING MACHINE AND METHOD OF USE

(75) Inventors: Bruce H. Hanson, Endicott, NY (US); Wayne M. Blackwell, Chenango Forks, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 106 days.

(21) Appl. No.: 10/075,596

(22) Filed: Feb. 15, 2002

(65) Prior Publication Data

US 2003/0155284 A1 Aug. 21, 2003

(51) Int. Cl.[7] ..... B65H 31/04

(52) U.S. Cl. ..... 271/213; 271/220; 271/223; 209/584

(58) Field of Search ..... 209/900, 584, 209/583; 310/225, 224, 223, 226

(56) References Cited

U.S. PATENT DOCUMENTS 3,335,859 A * 8/1967 Borchert et al. ..... 209/587
3,508,648 A * 4/1970 Stickney ..... 209/657
4,256,214 A * 3/1981 Back, Jr. ..... 198/367
4,909,500 A 3/1990 Grutzmacher et al.
5,261,667 A 11/1993 Breeding
5,429,348 A 7/1995 Martin
5,567,102 A 10/1996 Tanaka
5,833,232 A 11/1998 Ifkovits et al.
6,032,947 A * 3/2000 Parker ..... 271/213
6,280,136 B1 8/2001 Merwarth

FOREIGN PATENT DOCUMENTS

DE 12 31 628 12/1966
DE 100 57 052 A 1 6/2001

* cited by examiner

*Primary Examiner*—Donald P. Walsh
*Assistant Examiner*—Jonathan R. Miller
(74) *Attorney, Agent, or Firm*—Greenblum & Bernstein, P.L.C.

(57) ABSTRACT

A flat mail edge biasing machine and method of use for separating stacks of bulk flats (products) into at least two separate stacks each with bound edges oriented in a same direction. The flat mail edge biasing machine has a feed head mechanism which is capable of detecting a bound or non-bound edge of the product, and sort the products based on the detection. The sorting includes moving the products from a center compartment to side compartments. In the side compartments, the products stacks with the bound edges oriented in a same direction.

22 Claims, 5 Drawing Sheets

FLAT MAIL EDGE BIASING MACHINE AND METHOD OF USE

BACKGROUND OF THE INVENTION

1. Field of the Invention

The present invention generally relates to a flat mail edge biasing machine and method of use and, more particularly, to a flat mail edge biasing machine used for separating stacks of bulk flats into at least two separate stacks each with bound edges oriented in a same direction.

2. Background Description

Publishers are used throughout the world for pre-sorting bulk flats (i.e., magazines, newspapers or other items typically less than 1¼ inch in thickness). These publishers typically stack the product (flats) so that they can be provided to a postal facility or other delivery or transportation company for future delivery. However, these products typically have bound edges and non-bound edges, where the bound edges are thicker than the non-bound edges. This difference in thickness may cause a "banana" effect or a tipping of the product when stacked at the publishing facilities.

To ensure that the "banana" effect or tipping does not occur, the publisher will assemble the stacks of their products with the bound edges rotated every so many pieces in order to maintain a straight stack. By using this procedure, however, a mail sorting facility, whether it be a postal facility or other delivery or transportation facility, must reorient the stacks so that all of the bound edges are aligned. This allows for the sorting machines to properly sort and prepare for delivery of the product.

By way of example, in most modem postal facilities, major steps have been taken toward mechanization (e.g., automation) by the development of a number of machines and technologies. These machines and technologies include, amongst others, letter sorters, facer-cancelers, automatic address readers, parcel sorters, advanced tray conveyors, flat sorters, letter mail coding and stamp-tagging techniques and the like. As a result of these developments, postal facilities have become quite automated over the years, considerably reducing overhead costs.

In use, these machines and technologies such as flats sorting machines (FSM) are capable of processing more than 10,000 flats per hour by electronically identifying and separating prebarcoded mail, handwritten letters, and machine-imprinted pieces. Computer-driven single-line optical character readers (OCR) are used in this process.

However, many of the machines currently in use including, for example, the FSM require that the mail or flats be oriented in a certain manner in order for the machines to properly sort the mail for delivery. In order to accomplish this task for flats, human intervention is required to complete the product sorting process, i.e., rearrange stacks of flats received from the publisher to align the bound edges, to permit automated feeding of the product. This manual operation is both time consuming and costly, thus increasing overhead and hence delivery rates.

SUMMARY OF THE INVENTION

In a first aspect of the invention, a mail edge biasing machine is provided for sorting stacks of products into a homogenous orientation. The machine includes a plurality of compartments and a plurality of moveable plates associated with each of the plurality of compartments. In embodiments, each of the plurality of moveable plates is adapted to support the stacks of products. A stationary feed head mechanism is positioned proximate a central compartment of the plurality of compartments. The feed head mechanism transports the products from the central compartment to remaining compartments such that the products transported to the remaining compartments are each stacked proximate the moveable plates and oriented with bound edges in the homogenous orientation.

In another aspect of the present invention, a mail edge biasing system includes a general holding container divided into three separate compartments and opposing moveable guide walls separating the three separate compartments. Moveable plates, associated with each of the three separate compartments, are adapted to move in either a first direction or a second direction. A feed head mechanism is positioned over a central compartment of the three separate compartments and includes (i) a movement mechanism for moving products positioned proximate a central moveable plate from the central compartment to opposing side compartments and (ii) an optical edge recognition system for recognizing differences in bound and non-bound edges of the products.

In still yet another aspect of the present invention, a method is provided for orienting a stack of products in a same direction. The method includes the steps of providing a stack of products in a central compartment and incrementally moving the stack towards a feed head mechanism. A difference between a bound edge and a non bound edge of a top product is detected. The top product is elevated and transported to one of two side compartments based on the detecting step. All of the products transported to a first of the two side compartments are oriented in a first same direction and all products transported to a second of the two side compartments are oriented in a second same direction.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to a flat mail edge biasing machine used for separating stacks of bulk flats (products) into at least two stacks each with the bound edges of the products oriented in a same direction. This is accomplished by a system that includes (i) a feed head mechanism, (ii) an optical edge recognition system and (iii) adjustable stack guides or plates. In general, the optical edge detection system detects an orientation of the bound edge of the product (e.g., a difference in the roundness between bound vs. non bound edge of the product). This information is used to activate the feed head mechanism which, in turn, moves or slides the product in one of two directions in order to orient edges of the products in a homogenous manner, i.e., with all of the bound edges facing in a same direction. The plates are adapted to move the stacks of product toward and away from the feed head mechanism. In this manner, manual operations need not be performed on the stacks prior to mail sorting.

FLAT EDGE BIASING MACHINE OF THE PRESENT INVENTION

Figure 1:
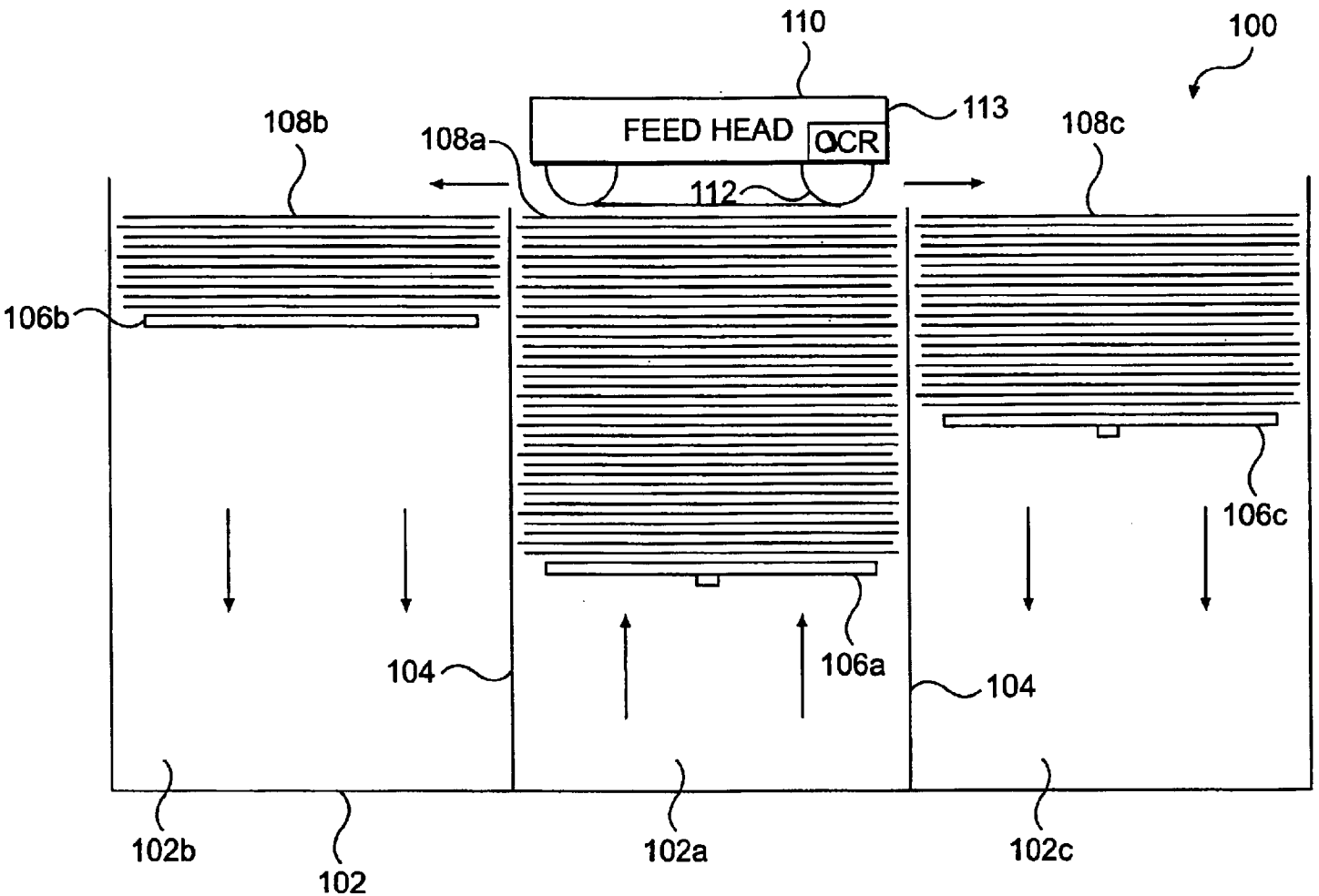
FIG. 1 is a schematic diagram of the mail biasing machine of the present invention.

Referring now to FIG. 1, a schematic diagram of the flat edge biasing machine is shown. The flat edge biasing machine is depicted generally as reference numeral 100 and includes a general holding container 102 divided into three separate compartments, a central compartment 102*a* and opposing side compartments 102*b* and 102*c*. The compartments 102*a*, 102*b* and 102*c* are separated by opposing moveable guide walls 104 positioned between the compartments 102*a*, 102*b* and 102*a*, 102*c*. In embodiments, the guide walls 104 are adjustable to accommodate different sized products, thus increasing the flexibility of the flat edge biasing machine of the present invention.

Moveable plates or paddles 106*a*, 106*b* and 106*c* are positioned within each of the compartments 102*a*, 102*b* and 102*c*, respectively. As shown by the arrows in FIG. 1, the moveable plate 106*a* is moveable in a first direction and moveable plates 106*b* and 106*c* are moveable in a second direction. In a preferred embodiment, moveable plates 106*b* and 106*c* are movable in a direction opposite to that of the moveable plate 106*a*. The moveable plates 106*a*, 106*b* and 106*c* are moveable via belts or other mechanisms, discussed with reference to FIG. 2.

Still referring to FIG. 1, stacks of products 108*a*, 108*b* and 108*c*, respectively, are stacked on or positioned proximate to each of the moveable plates 106*a*, 106*b* and 106*c*. In particular, products stacked in a counter rotated manner (i.e., products with the bound edges rotated every so many pieces in order to maintain a straight stack) are stacked on or proximate to central plate 102*a*, where products oriented in a first homogenous orientation are stacked on or proximate to opposing side plate 108*b* and products stacked in a second homogenous orientation are stacked on opposing side plate 108*c*.

A feed head mechanism 110, preferably fixed or stationary, is positioned over the central compartment 102*a*, and more specifically over the central stack 108*a*. The feed head mechanism 110 includes a movement mechanism generally depicted as reference numeral 112 (described with reference to FIG. 4) and an optical edge recognition system 113. The movement mechanism 112 is designed to move or slide the central stack of products 108*a* from the central compartment 102*a* to either of the side compartments 102*b* or 102*c* based on information received from the optical edge recognition system 113. A belt generally depicted as reference numeral 118 is also provided for moving the product (discussed further with reference to FIG. 4).

Figure 2:
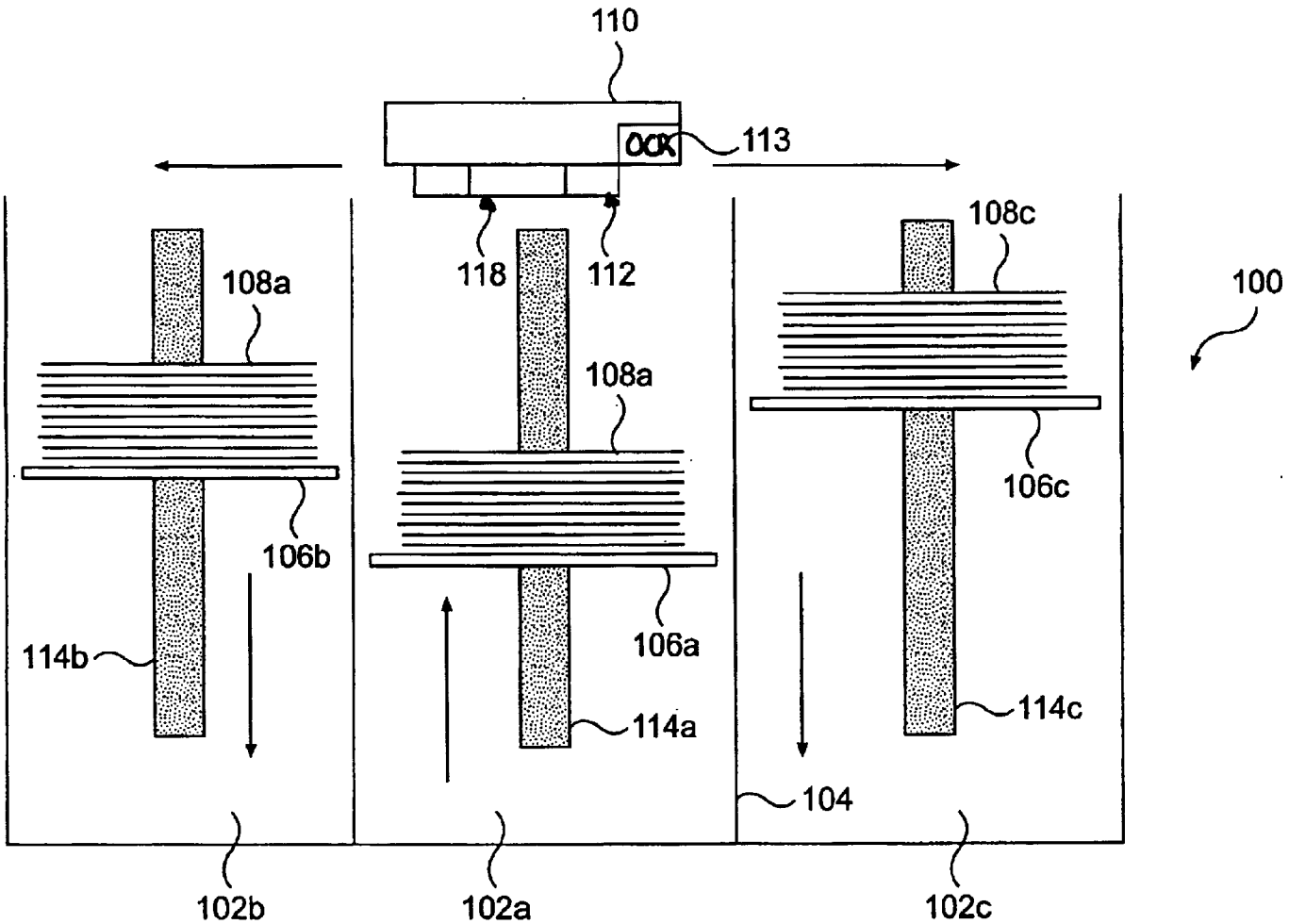
FIG. 2 shows a belt drive system for moving stacks of products.

FIG. 2 shows a belt drive system for moving both the respective stacks 108*a*, 108*b* and 108*c* as well as the moveable plates 106*a*, 106*b* and 106*c*. More specifically, belts 114*a*, 114*b* and 114*c* are adapted to move the stacks 108*a*, 108*b* and 108*c* in the respective directions (see arrows), i.e., belt 114*a* incrementally moves the stack 108*a* toward the feed head mechanism 110 and the belts 114*b* and 114*c*, on the other hand, incrementally move the stacks 108*b* and 108*c*, respectively, in a direction which is preferably in a second opposing direction. In embodiments, the incremental movement of belt 114*a* moves the stack 108*a* substantially in contact with or proximate to the feed head mechanism 110 in order to allow the feed head mechanism to move product from the central stack 108*a* to either the compartment 102*b* or 102*c*, depending on the location of the bound edge of the product. Additionally, the incremental movement of the belts 114*b* and 114*c* move the stacks 108*b* and 108*c* downward thereby allowing further product to be placed on the respective stacks. In a preferred embodiment, the respective stacks of product are positioned on the respective belts in order to better facilitate movement thereof.

Figure 3:
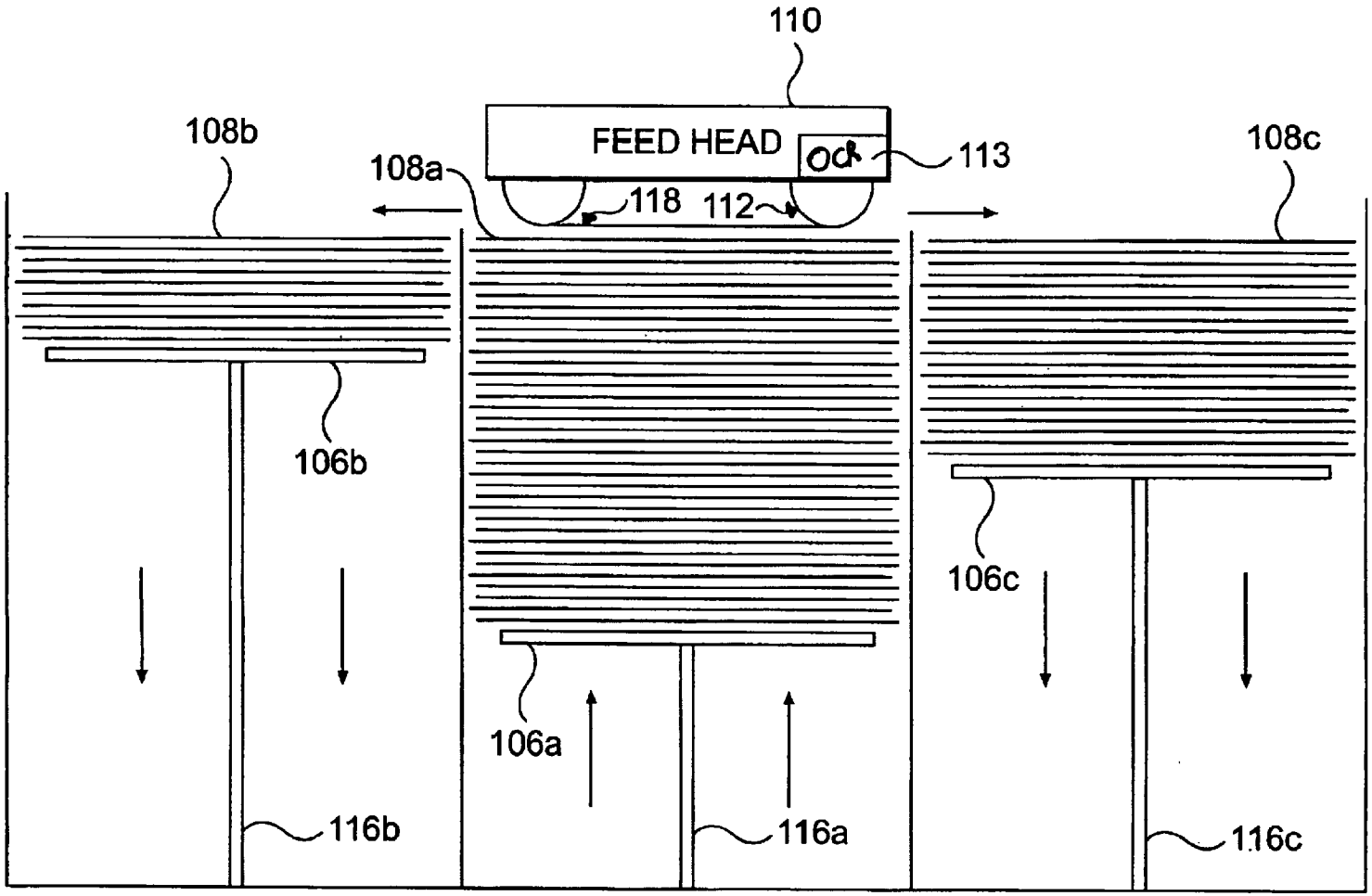
FIG. 3 shows an alternative drive system for moving the stacks of product.

FIG. 3 shows an alternative drive system for moving both the stacks 108*a*, 108*b* and 108*c* as well as the moveable plates 106*a*, 106*b* and 106*c*. In particular, each of the moveable plates 106*a*, 106*b* and 106*c* are connected to a moveable piston/cylinder assembly 116*a*, 116*b* and 116*c*. This system is alternatively referred to as a bottom elevator type moving system which allows the tops of the stacks to remain in a fixed plane (relative to the feed head mechanism) for ease of movement of a product from stack to stack. In this embodiment, the stacks should preferably be at approximately a 15° angle with respect to the vertical plane.

Figure 4:
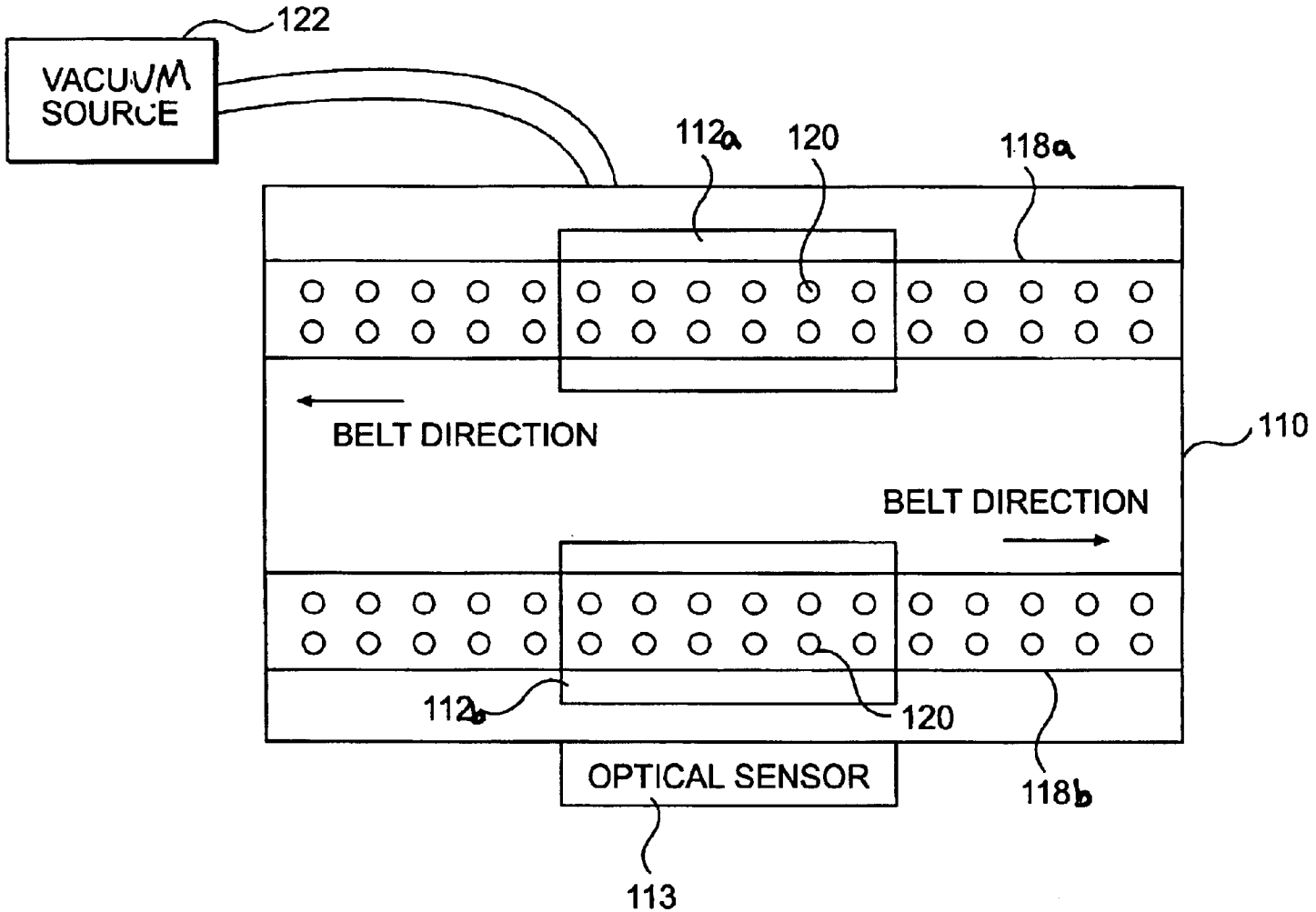
FIG. 4 shows a bottom view of a feed head mechanism.

FIG. 4 shows a bottom view of the feed head mechanism 110. The feed head mechanism 110 includes two separate vacuum chamber assemblies 112*a* and 112*b*, each with multiple chambers and a belt 118*a* and 118*b*, respectively, preferably perforated and coated with teflon® or other non-stick material. The vacuum chambers 112*a* and 112*b* are connected to a vacuum source 122 which provides a vacuum or suctioning to each of the suction ports 120, depending on the information received from the optical edge recognition system 113 (i.e., the orientation or position of a bound edge of the product). In operation, the vacuum source 122 provides a vacuum to the vacuum chamber 112*a* and 112*b* of one of the belts 118*a* and 118*b*, respectively which, in turn, then moves the product from the central stack 108*a*. The appropriate belt 118*a* or 118*b* is then activated so as to transport the product from the central stack 108*a* to one of the other stacks 108*b* and 108*c*. The suctioning can then be deactivated. The belts or other movement mechanism may then incrementally move the stacks, as discussed above.

Figure 5:
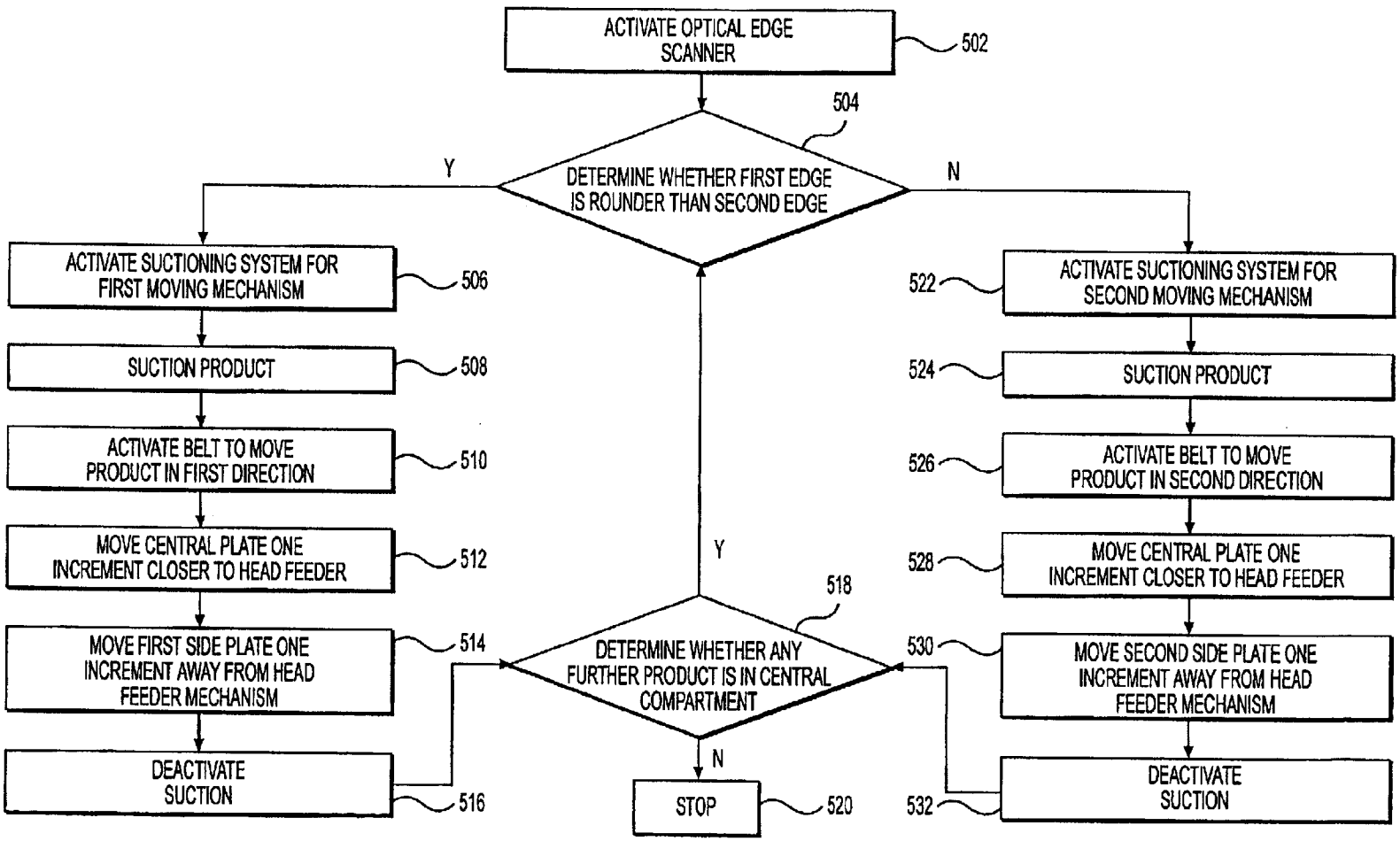
FIG. 5 is a flow diagram showing the steps of implementing the method of the present invention.

FIG. 5 is a flow diagram showing the steps of implementing the method of the present invention. The steps of the present invention may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM). FIG. 5 may equally represent a high level block diagram of the system of the present invention, implementing the steps thereof.

In particular, in step 502, the optical edge recognition system 113 is activated. In step 504, a determination is made as to whether a first edge is rounder than a second edge of the product. If the first edge is rounder than the second edge, in step 506, the suctioning system for the first moving mechanism 112 is activated. In step 508, the product in the central stack 108*a* is elevated or suctioned. In step 510, the belt is activated and the product is transported from the central stack 108*a* to the side compartment 102*b* (or 102*c*). The central plate 106*a* is then incrementally moved towards the feed head mechanism, in step 512, and the side plate 106*a* (or 106*b*) in which the product was positioned thereon is incrementally moved downward in step 514. In step 516, the suctioning mechanism 122 is deactivated. Note that the deactivation of the suctioning mechanism 122 may be performed at any time after step 510.

In step 518, a next determination is made as to whether there is any further product in the central compartment 102*a*. If not, then the system stops in step 520. However, if there is further product in the central compartment 102*a*, then the processes reverts back to step 504.

Now, in step 504, if the determination is made that the second edge is rounder than the first edge, in step 522, the suctioning system for the second moving mechanism 112 is activated. In step 524, the product in the central stack 108*a* is elevated or suctioned. In step 526, the belt is activated and the product is transported from the central stack to the other side compartment 102*c* (or 102*b*). The central plate 106*a* is then incrementally moved towards the feed head mechanism, in step 528, and the side plate 106*b* (or 106*a*) in which the product was positioned thereon is incrementally moved downward in step 530. In step 532, the suctioning mechanism 122 is deactivated. Again the deactivation of the suctioning mechanism 122 may be performed at any time after step 526. Steps 518 and 520 are then provided. In this manner, two stacks 108*b* and 108*c* are created that have bound edges in a homogenous orientation.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. A mail edge biasing machine for sorting stacks of products in a homogenous orientation, comprising:

a plurality of compartments;

a plurality of moveable plates associated with each of the plurality of compartments;

detecting means for detecting differences in bound and non-bound edges of the products; and a stationary feed head mechanism positioned proximate a central compartment of the plurality of compartments, the feed head mechanism being capable of transporting the products from the central compartment to remaining compartments of the plurality of compartments, wherein the feed head mechanism allows arrangement of products transported to the remaining compartments to be each stacked proximate the moveable plates and oriented with bound edges in the homogenous orientation according to an output of the detecting means.

2. The mail edge biasing machine of claim 1, wherein the feed head mechanism separately transports each of the products from the central compartment to the remaining compartments.

3. The mail edge biasing machine of claim 1, wherein the central moveable plate supports the products which have the bound edges oriented in opposing directions.

4. The mail edge biasing machine of claim 1, wherein the plurality of compartments includes the central compartment and opposing side compartments.

5. The mail edge biasing machine of claim 1, wherein the feed head mechanism comprises:

a belt driven transportation mechanism having a plurality of suction ports; and a vacuum source in communication with the plurality of suction ports.

6. The mail edge biasing machine of claim 5, wherein the belt driven transportation mechanism is two belt driven transportation mechanisms adapted to transport stack of products in opposing directions from the central compartment to the remaining compartments which are opposing side compartments.

7. The mail edge biasing machine of claim 6, wherein the vacuum source, via the plurality of suction ports, moves a product of the stack of products from the central compartment for transportation to either of the opposing side compartments.

8. The mail edge biasing machine of claim 1, further comprising moveable walls separating each of the plurality of compartments.

9. The mail edge biasing machine of claim 1, further comprising a plurality of belt drives for incrementally moving the plurality of moveable plates and stacks of products.

10. The mail edge biasing machine of claim 1, further comprising a plurality of bottom elevator moving systems for incrementally moving the plurality of moveable plates and stacks of products, and which allows tops of the stacks of products to remain in a fixed plane relative to the feed head mechanism.

11. The mail edge biasing machine of claim 1, wherein the feed head mechanism includes the detecting means which is an optical edge recognition system for detecting a bound edge of the product.

12. The mail edge biasing machine of claim 11, wherein information received from the optical edge recognition system is used for separately transporting products of the stack of products from the central compartment to the remaining compartments which are opposing side compartments, thereby orienting the stack of products on each of the opposing side compartments with bound edges in the homogenous orientation.

13. The system of claim 1, wherein the moveable plates include at least a center plate and two opposing side plates, the center plate moveable in a first direction and the two opposing side plates moveable in a second opposing direction.

14. A mail edge biasing system, comprising:

a general holding container divided into three separate compartments;

opposing moveable guide walls separating the three separate compartments;

moveable plates associated with each of the three separate compartments, the moveable plates being adapted to move in either a first direction or a second direction;

a feed head mechanism positioned over a central compartment of the three separate compartments, the feed head mechanism including:

an optical edge recognition system for recognizing differences in bound and non-bound edges of the products; and a movement mechanism for moving products positioned proximate a central moveable plate from the central compartment to opposing side compartments of the three separate compartments based on the recognition of the bound and non-bound edges of the products.

15. The mail edge biasing system of claim 14, wherein the movement mechanism is two belt driven systems and each of the two belt driven systems includes a plurality of suctioning ports for moving or elevating the products positioned proximate the central moveable plate.

16. The mail edge biasing system of claim 15, wherein the two belt driven systems move the products from the central compartment to the opposing side compartments based on information received from the optical edge recognition system.

17. The mail edge biasing system of claim 14, further comprising a belt driven system for moving the moveable plates, wherein a central moveable plate is incrementally moveable towards the head feed mechanism and opposing side moveable plates are incrementally moveable away from the feed head mechanism.

18. A method of orienting a stack of products in a same direction, comprising the steps of:

providing a stack of products in a central compartment;

incrementally moving the stack of products in the central compartment towards a feed head mechanism;

detecting a difference between bound and non-bound edges of a top product of the stack of products; and transporting the top product to one of two side compartments based on the detecting step, wherein all products transported to a first of the two side compartments are oriented in a first same direction and all products transported to a second of the two side compartments are oriented in a second same direction.

19. The method of claim 18, further comprising repeating the steps of claim 17 until the stack of products in the central compartment is depleted.

20. The method of claim 18, wherein the product is elevated by the feed head mechanism.

21. The method of claim 18, wherein the detecting step is based on a difference in thickness between at least two of the edges of a same product to determine the bound edge and the non bound edge of the top product.

22. The method of claim 18, wherein the transporting step includes elevating the top product.

* * * * *